US009791885B2

(12) United States Patent
Suzumura et al.

(10) Patent No.: US 9,791,885 B2
(45) Date of Patent: Oct. 17, 2017

(54) ROTATING-LEVER-POSITION-HOLDING DEVICE

(71) Applicant: AISIN SEIKI KABUSHIKI KAISHA, Kariya-shi, Aichi (JP)

(72) Inventors: Makoto Suzumura, Chita (JP); Takashi Nishio, Kariya (JP); Yasuhiko Sono, Hekinan-shi (JP); Kazunori Kojima, Aichi-ken (JP); Masanari Iwata, Ichinomiya (JP); Satoshi Fukuchi, Kariya (JP); Yusuke Yamada, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 324 days.

(21) Appl. No.: 14/650,754

(22) PCT Filed: Dec. 5, 2013

(86) PCT No.: PCT/JP2013/082695
§ 371 (c)(1),
(2) Date: Jun. 9, 2015

(87) PCT Pub. No.: WO2014/091995
PCT Pub. Date: Jun. 19, 2014

(65) Prior Publication Data

US 2015/0323954 A1 Nov. 12, 2015

(30) Foreign Application Priority Data

Dec. 10, 2012 (JP) ..... 2012-269435

(51) Int. Cl.
*G05G 5/06* (2006.01)
*E05B 81/16* (2014.01)
(Continued)

(52) U.S. Cl.
CPC ..... *G05G 5/06* (2013.01); *E05B 15/0053* (2013.01); *E05B 81/16* (2013.01); *E05B 2015/0493* (2013.01); *Y10T 74/20006* (2015.01)

(58) Field of Classification Search
CPC ..... E05B 15/0053; G05G 5/06
See application file for complete search history.

(56) References Cited

U.S. PATENT DOCUMENTS 6,435,573 B1 * 8/2002 Szablewski ..... E05B 81/14 292/201
2001/0024040 A1 * 9/2001 Spurr ..... E05B 85/243 292/216

(Continued)

FOREIGN PATENT DOCUMENTS

JP 2002-132363 A 5/2002
JP 2009-46908 A 3/2009

(Continued)

OTHER PUBLICATIONS

International Search Report (PCT/ISA/210) mailed on Mar. 11, 2014, by the Japanese Patent Office as the International Searching Authority for International Application No. PCT/JP2013/082695.

(Continued)

*Primary Examiner* — Terence Boes
(74) *Attorney, Agent, or Firm* — Buchanan Ingersoll & Rooney PC

(57) ABSTRACT

A position holding device for a rotating lever includes a rotating lever and a torsion spring. The rotating lever is elastically held at two positions, that is, a first position and a second position. The torsion spring includes a coiled part, and a first arm part and a second arm part each extending from the coiled part. The first arm part has a mountain portion formed thereon, and the second arm part has a reversely urging portion formed thereon. An urging force of the reversely urging portion is applied to the rotating lever (Continued)

as a braking force against an urging force of the mountain portion. Further, a regulating member is formed on a base member so as to abut against the first arm part when the rotating lever rotates toward the first position through a neutral position.

6 Claims, 9 Drawing Sheets

(51) Int. Cl.
*E05B 15/00* (2006.01)
*E05B 15/04* (2006.01)

(56) References Cited

U.S. PATENT DOCUMENTS

2002/0167178 A1* 11/2002 Spurr ..... E05B 77/02 292/201
2011/0247447 A1 10/2011 Nagaoka et al.
2011/0254287 A1* 10/2011 Akizuki ..... E05B 77/06 292/223
2014/0028036 A1 1/2014 Akizuki et al.

FOREIGN PATENT DOCUMENTS

JP 4277441 B2 6/2009
JP 2011-221752 A 11/2011
JP 2012-225112 A 11/2012

OTHER PUBLICATIONS

Written Opinion (PCT/ISA/237) mailed on Mar. 11, 2014, by the Japanese Patent Office as the International Searching Authority for International Application No. PCT/JP2013/082695.

* cited by examiner

ROTATING-LEVER-POSITION-HOLDING DEVICE

TECHNICAL FIELD

The present invention relates to a position holding device for a rotating lever, which is capable of holding the rotating lever between two positions (first position and second position).

BACKGROUND ART

Hitherto, as this type of position holding device, a position holding device disclosed in Patent Literature 1 is known. The position holding device disclosed in Patent Literature 1 includes a base member, a rotating lever, a first stopper member, a second stopper member, and a torsion spring. The rotating lever is rotatably supported by the base member. The first stopper member abuts against the rotating lever when the rotating lever rotates in one direction, to thereby hold the rotating lever at a first position. The second stopper member abuts against the rotating lever when the rotating lever rotates in another direction, to thereby hold the rotating lever at a second position. The torsion spring is interposed between the rotating lever and the base member, and is configured to urge the rotating lever toward the first stopper member when the rotating lever is located at the first position, and to urge the rotating lever toward the second stopper member when the rotating lever is located at the second position.

The torsion spring used in the position holding device disclosed in Patent Literature 1 includes a coiled part mounted so as to be rotatable about a boss portion formed upright on the base member, and a first arm part and a second arm part formed so as to extend from both end portions of a wire forming the coiled part in a radial direction substantially orthogonal to an axial direction of the boss portion, and to face each other while sandwiching an engagement portion formed on the rotating lever from both sides thereof.

CITATION LIST

Patent Literature

[PTL 1] JP 4277441 B

SUMMARY OF INVENTION

Technical Problem

According to the position holding device disclosed in Patent Literature 1, convex mountain portions are formed on the first arm part and the second arm part of the torsion spring so that peak portions thereof face each other. When the rotating lever rotates from the second position to the first position, the engagement portion of the rotating lever climbs over both the mountain portions. Before the engagement portion climbs over both the mountain portions, the rotating lever is urged in a direction opposite to a rotational direction of the rotating lever (toward the second stopper member) with an elastic force received from one inclined portion of each of both the mountain portions. After the engagement portion climbs over both the mountain portions, the rotating lever is urged in the same direction as the rotational direction (toward the first stopper member) with an elastic force received from another inclined portion of each of both the mountain portions. When the rotating lever rotates from the first position to the second position, the engagement portion also climbs over both the mountain portions. Before the engagement portion climbs over both the mountain portions, the rotating lever is urged in a direction opposite to a rotational direction of the rotating lever (toward the first stopper member) with an elastic force received from one inclined portion of each of both the mountain portions. After the engagement portion climbs over both the mountain portions, the rotating lever is urged in the same direction as the rotational direction (toward the second stopper member) with an elastic force received from another inclined portion of each of both the mountain portions.

That is, according to the position holding device disclosed in Patent Literature 1, the first arm part and the second arm part of the torsion spring urge the rotating lever in cooperation with each other, and hence, irrespective of whether the rotating lever abuts against the first stopper member or the second stopper member, the urging force of the first arm part and the urging force of the second arm part are applied in the same direction. Therefore, after the engagement portion climbs over the mountain portions, the rotating lever forcefully strikes against the first stopper member or the second stopper member due to the great urging force, resulting in significant abutment noise.

It is an object of the present invention to provide a position holding device for a rotating lever, which is capable of reducing abutment noise when a rotating lever abuts against a stopper member.

Solution to Problem

According to one embodiment of the present invention, there is provided a position holding device for a rotating lever, including: a base member having a support portion; a rotating lever rotatably supported by the base member; a first stopper member configured to abut against the rotating lever when the rotating lever rotates in a first direction, to thereby hold the rotating lever at a first position; a second stopper member configured to abut against the rotating lever when the rotating lever rotates in a second direction opposite to the first direction, to thereby hold the rotating lever at a second position; and a torsion spring interposed between the rotating lever and the base member, the torsion spring being configured to urge the rotating lever in the first direction when the rotating lever is located at the first position, and to urge the rotating lever in the second direction when the rotating lever is located at the second position. The torsion spring includes: a coiled part mounted so as to be rotatable about the support portion; and a first arm part and a second arm part each extending from the coiled part so as to sandwich an engagement portion formed on the rotating lever from both sides thereof. The first arm part includes a mountain portion formed into a shape that is convex toward the second arm part. The mountain portion includes: a peak portion onto which the engagement portion climbs when the rotating lever is located at a neutral position between the first position and the second position; a first inclined portion configured to urge the rotating lever in the first direction when the rotating lever is located at a rotational position between the neutral position and the first position; and a second inclined portion configured to urge the rotating lever in the second direction when the rotating lever is located at a rotational position between the neutral position and the second position. The second arm part includes a reversely urging portion formed thereon, which is configured to engage with the engagement portion when the rotating lever is located at the rotational position between the neutral position and the first position, to thereby urge the rotating lever in the second direction with a force smaller than a force for urging the rotating lever in the first direction by the first inclined portion. Further, the base member includes a regulating member configured to abut against the first arm part when the rotating lever rotates toward the first position through the neutral position.

Advantageous Effects of Invention

According to the one embodiment of the present invention as described above, when the rotating lever rotates from the first position to the second position and from the second position to the first position, the engagement portion of the rotating lever climbs over the mountain portion formed on the first arm part. After the engagement portion climbs over the mountain portion, the rotating lever receives the elastic force of the first arm part at the engagement portion, thereby being urged in a rotational direction. Therefore, tactile feedback can be given during the rotational operation of the rotating lever.

Further, when the rotating lever rotates from the second position toward the first position through the neutral position, the rotating lever is urged in the first direction as the rotational direction with the elastic force applied from the first inclined portion of the first arm part to the engagement portion, and is also urged in the second direction opposite to the rotational direction with the elastic force applied from the reversely urging portion of the second arm part to the engagement portion. That is, a rotational assist force for urging the rotating lever in the rotational direction of the rotating lever is obtained from the first inclined portion of the first arm part, whereas a rotational resistance force for urging the rotating lever in the direction opposite to the rotational direction of the rotating lever is obtained from the reversely urging portion of the second arm part. In this case, the rotational resistance force is smaller than the rotational assist force, and hence the direction of the resultant force of those forces is the rotational direction of the rotating lever (first direction). Thus, the rotating lever is urged in the rotational direction, but the rotational resistance force from the reversely urging portion acts onto the rotating lever as a braking force, to thereby reduce the force when the rotating lever strikes against the first stopper member through the rotation in the rotational direction. Therefore, the abutment noise is reduced when the rotating lever abuts against the first stopper member.

Further, according to the one embodiment of the present invention, the first arm part abuts against the regulating member when the rotating lever rotates toward the first position through the neutral position. It is preferred that the first arm part abut against the regulating member immediately before the rotating lever reaches the first position. After the first arm part abuts against the regulating member, further deflection (movement) of the first arm part is regulated, and hence the engagement portion cannot further be squeezed by the first arm part. As a result, a greater elastic force is prevented from being applied to the engagement portion. Therefore, the elastic force of the first arm part when the rotating lever reaches the first position is limited to the elastic force of the first arm part when the first arm part abuts against the regulating member. That is, through the abutment of the regulating member against the first arm part before the rotating lever reaches the first position, the elastic force to be applied to the engagement portion can be reduced as compared to the case where the regulating member does not abut against the first arm part. Therefore, the urging force (rotational assist force) of the first arm part in the first direction (rotational direction) is reduced, thereby being capable of further reducing the abutment noise when the rotating lever abuts against the first stopper member.

It is preferred that the reversely urging portion include: a first reversely urging portion configured to engage with the engagement portion when the rotating lever is located at the rotational position between the neutral position and the first position, to thereby urge the rotating lever in the second direction with the force smaller than the force for urging the rotating lever in the first direction by the first inclined portion; and a second reversely urging portion configured to engage with the engagement portion when the rotating lever is located at the rotational position between the neutral position and the second position, to thereby urge the rotating lever in the first direction with a force smaller than a force for urging the rotating lever in the second direction by the second inclined portion.

According to this structure, the reversely urging portion includes the first reversely urging portion and the second reversely urging portion. Therefore, the braking force is obtained by the first reversely urging portion before the rotating lever abuts against the first stopper member through the rotation in the first direction, and the braking force is also obtained by the second reversely urging portion before the rotating lever abuts against the second stopper member through the rotation in the second direction. Thus, it is possible to reduce the abutment noise when the rotating lever abuts against the first stopper member and when the rotating lever abuts against the second stopper member.

It is preferred that the torsion spring be mounted to the base member, and be formed so as to assume a crossed state in which the first arm part and the second arm part are crossed under a free state. Further, it is preferred that the regulating member be configured to bring the torsion spring out of the crossed state by guiding, when the torsion spring in the free state is to be mounted to the base member, the first arm part and the second arm part so that an interval between the first arm part and the second arm part is increased.

Further, it is preferred that the regulating member be a rib formed on the base member so as to be arranged upright from the base member. It is preferred that this rib include: a first side wall surface and a second side wall surface each extending along an upright direction of the rib; and an upper wall surface connecting an upper end of the first side wall surface and an upper end of the second side wall surface, that the first side wall surface be abuttable against the first arm part, and that the upper wall surface include: a first inclined upper surface portion, which is inclined in an upward direction from the upper end of the first side wall surface so that a position of the upper end of the first side wall surface is lowest in height; and a second inclined upper surface portion, which is inclined in the upward direction from the upper end of the second side wall surface so that a position of the upper end of the second side wall surface is lowest in height.

In this case, it is preferred that the torsion spring be mounted to the base member by arranging the first arm part of the torsion spring in the free state on the first inclined upper surface portion, arranging the second arm part of the torsion spring on the second inclined upper surface portion, and under a state in which the first arm part is arranged on the first inclined upper surface portion and the second arm part is arranged on the second inclined upper surface portion, pushing the torsion spring downward in the free state so that the interval between the first arm part and the second arm part is increased, to thereby mount the torsion spring to the base member under a state in which the engagement portion is sandwiched between the first arm part and the second arm part.

According to this structure, the regulating member can be formed integrally with the base member as the rib formed on the base member, thereby being capable of reducing the manufacturing cost as compared to the case where the regulating member is formed separately from the base member. Further, when mounting the torsion spring to the base member, the first arm part of the torsion spring is brought into abutment against the first inclined upper surface portion of the rib and the second arm part of the torsion spring is brought into abutment against the second inclined upper surface portion of the rib. In this state, the torsion spring is pushed toward the base member. Along with this, the first arm part slides down along the first inclined upper surface portion and the second arm part slides down along the second inclined upper surface portion. The sliding directions of both the arm parts are opposite to each other, and hence, as both the arm parts slide down along both the inclined upper surface portions, the interval between both the arm parts is increased. When both the arm parts are then disengaged from the upper wall surface of the rib, the first arm part and the second arm part are opened so as to sandwich the rib between both the arm parts. Then, the torsion spring is mounted to the base member under a state in which the engagement portion is sandwiched between the first arm part and the second arm part thus opened. In this manner, the torsion spring is mounted easily under the opened state, and hence the mountability is enhanced.

Further, it is preferred that the second arm part include a straight portion formed so as to extend linearly, and that the first reversely urging portion and the second reversely urging portion be formed on the straight portion. According to this structure, the first reversely urging portion and the second reversely urging portion are formed on the single straight portion, and hence the torsion spring according to the one embodiment of the present invention can be manufactured easily, with the result that the manufacturing cost can be reduced.

DESCRIPTION OF EMBODIMENTS

Figure 1:
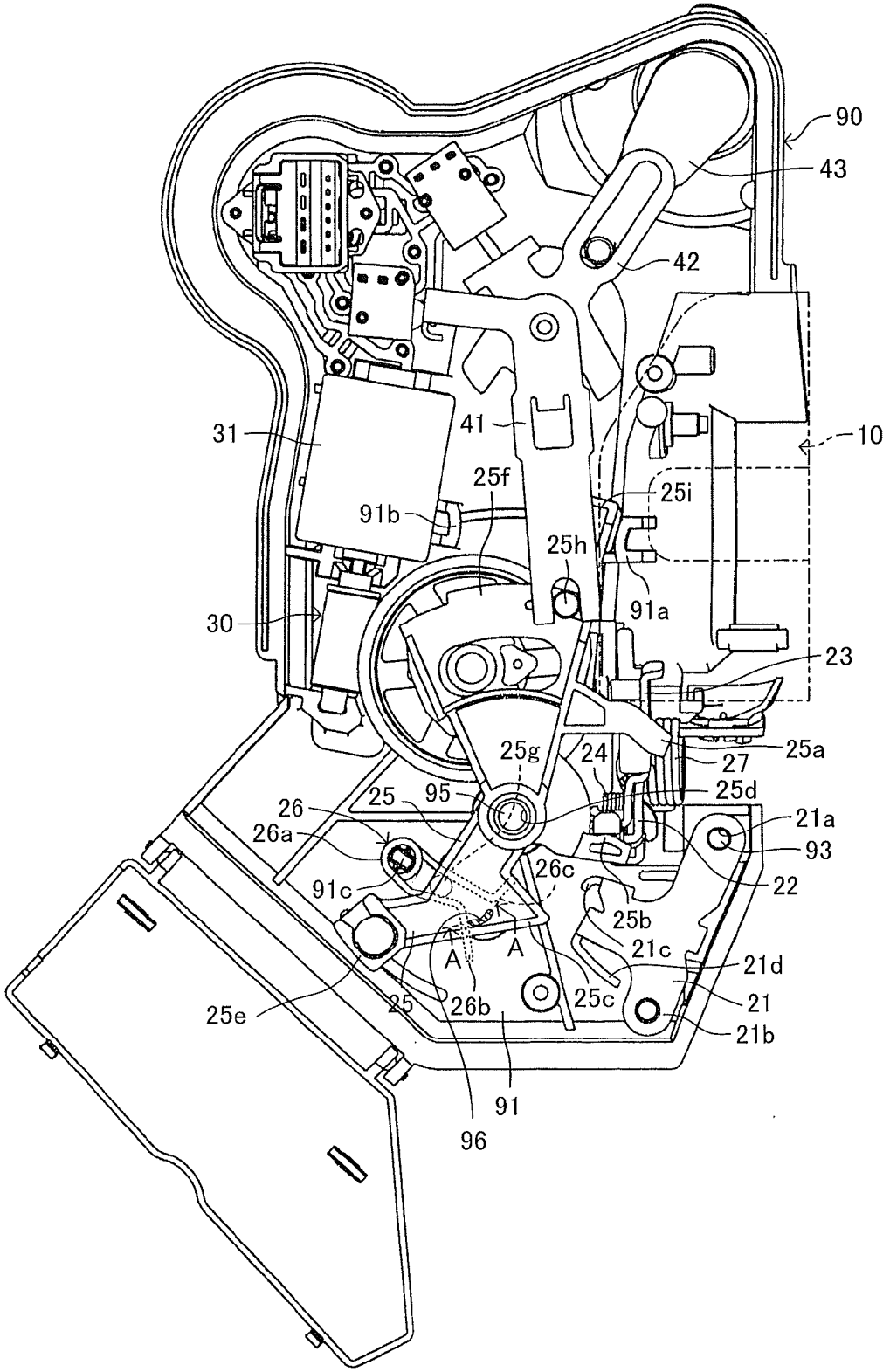
FIG. 1 is a view illustrating a vehicle door lock device to which a position holding device for a rotating lever according to an embodiment of the present invention is applied.

Now, embodiments of the present invention are described with reference to the drawings. FIG. 1 is a view illustrating a vehicle door lock device to which a position holding device for a rotating lever according to an embodiment of the present invention is applied. The vehicle door lock device is mounted to a door (not shown) arranged on the front right side of a vehicle. The vehicle door lock device includes a latch mechanism 10, an inside open lever 21, an outside open lever 22, an open link 23, a spring 24, an active lever (rotating lever) 25, and a housing 90 (base member). Further, the vehicle door lock device also includes an unlocking position holding guide 92*a* (see FIG. 2) arranged on a cover (in FIG. 1, removed from a main body 91 and hence not shown) of the housing 90, and a locking position holding guide 25*a* and a push arm portion 25*b* arranged on the active lever 25.

As is well known, the latch mechanism 10 is configured to hold the door in a closed state with respect to a body (vehicle body (not shown)), and is mounted to the housing 90 including the main body 91 and the cover (not shown). The latch mechanism 10 is mounted to the door together with the housing 90. The latch mechanism 10 includes a latch (not shown) engageable with and disengageable from a striker (not shown) that is fixed to the body, a pawl (not shown) that is engageable with and disengageable from the latch and is capable of maintaining and releasing the engagement of the latch with the striker, and a lift lever 12 (see FIG. 2) arranged so as to be rotatable integrally with the pawl (not shown).

Figure 2:
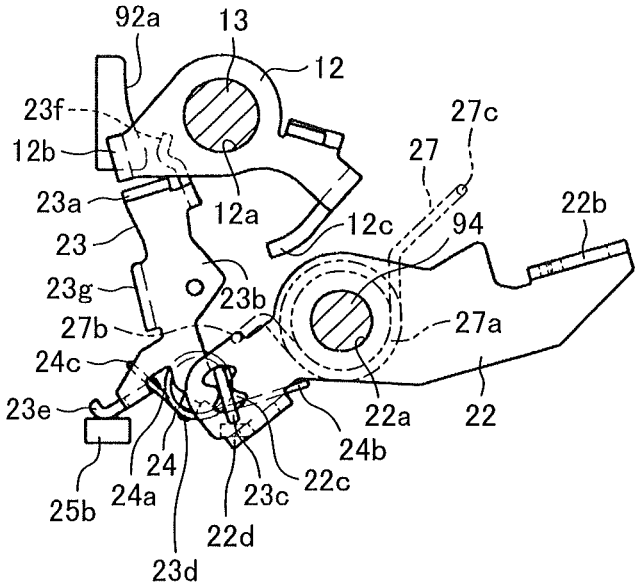
FIG. 2 is a view illustrating a relationship in an unlocked state between an outside open lever, an open link, an active lever, and a lift lever and an unlocking position holding guide formed on a cover of a housing.

As illustrated in FIG. 2, the lift lever 12 has a fitting hole 12*a* formed therein, and is mounted integrally to a rotation shaft 13 of the pawl (not shown) through the fitting hole 12*a* thereof. Therefore, the lift lever 12 rotates integrally with the pawl (not shown). The lift lever 12 includes an engagement arm portion 12*b* engageable with and disengageable from a push head portion 23*a* of the open link 23, and a push leg portion 12*c* engageable with and disengageable from a receiving body portion 23*b* of the open link 23. A main portion of the lift lever 12 (portion of the lift lever 12 that is fitted to the rotation shaft 13) rotates in a plane substantially parallel to the drawing sheet of FIG. 2.

In the above-mentioned latch mechanism 10, when the latch engages with the striker and their engagement is maintained, the door is held in a closed state (latched state). Further, in the latch mechanism 10, when the latch disengages from the striker so that the latch separates from the striker, the door shifts from the closed state to an opened state (unlatched state).

The inside open lever 21 is rotationally drivable from an initial position (return position illustrated in FIG. 1) to an actuation position (position at which the outside open lever 22 and the open link 23 are lifted up from the position illustrated in FIG. 1 by a predetermined amount) along with a door opening operation of an inside door handle (not shown) that is arranged on an inner side of the door. As illustrated in FIG. 1, the inside open lever 21 has a support hole 21*a* formed therein, and is rotatably mounted to the housing 90 through intermediation of a support shaft 93 at the support hole 21*a*. The inside open lever 21 includes an operation arm portion 21*b* linked to the inside door handle through an operation cable (not shown), a first push arm portion 21*c* engageable with and disengageable from an engagement arm portion 22*d* of the outside open lever 22, and a second push arm portion 21*d* engageable with and disengageable from a receiving portion 25*c* of the active lever 25.

Figure 3:
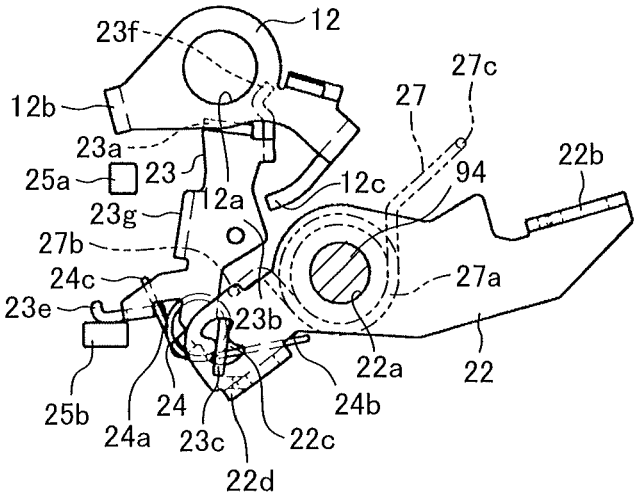
FIG. 3 is a view illustrating a relationship in a locked state between the outside open lever, the open link, the active lever, and the lift lever and a locking position holding guide formed on the active lever.

The outside open lever 22 is rotationally drivable from an initial position (return position illustrated in FIGS. 2 and 3) to an actuation position (position at which the outside open lever 22 is rotated from the return position by a predetermined amount in the clockwise rotation direction of FIGS. 2 and 3) along with a door opening operation of an outside door handle (not shown) that is arranged on an outer side of the door. The outside open lever 22 has a support hole 22*a* formed therein so as to be arranged substantially orthogonal to the support hole 21*a* formed in the inside open lever 21. At the support hole 22*a*, the outside open lever 22 is rotatably mounted to the housing 90 through intermediation of a support shaft 94. The outside open lever 22 includes an operation portion 22*b* linked to the outside door handle through intermediation of an operation force transmission member (not shown) such as a link, a coupling hole portion (coupling portion) 22*c* coupled to the open link 23, and the engagement arm portion 22*d* engageable with and disengageable from the first push arm portion 21*c* of the inside open lever 21.

Further, the outside open lever 22 is urged by a spring 27 toward the initial position. The spring 27 urges the outside open lever 22 relative to the housing 90 by a predetermined urging force toward the initial position (position illustrated in FIGS. 2 and 3). Further, the spring 27 includes a coil portion 27*a* mounted to the support shaft 94, which is arranged on the housing 90, and a pair of arm portions 27*b* and 27*c* extending radially outward from both end portions of a wire forming the coil portion 27*a*. The arm portion 27*b* on one side engages with the outside open lever 22, and the arm portion 27*c* on the other side engages with the housing 90.

The open link 23 includes the push head portion 23*a* and the receiving body portion 23*b* mentioned above, and further includes a coupling leg portion 23*c* and a support portion 23*d*. The open link 23 is mounted into the coupling hole portion (coupling portion) 22*c* of the outside open lever 22 at the coupling leg portion 23*c* so as to be capable of tilting by a predetermined degree in a right-and-left direction of FIG. 2. A main portion (push head portion 23*a*, receiving body portion 23*b*, and the like) of the open link 23 is tilted in a plane substantially parallel to the drawing sheet of FIG. 2. Thus, this plane is disposed in parallel to a plane in which a main portion of the lift lever 12 rotates. Further, the open link 23 supports the spring 24 at the support portion 23*d*. Further, the open link 23 includes an engagement leg portion 23*e* engageable with and disengageable from the push arm portion 25*b* of the active lever 25, an engagement arm portion 23*f* engageable with and disengageable from the unlocking position holding guide 92*a* of the housing 90, and an engagement body portion 23*g* engageable with and disengageable from the locking position holding guide 25*a* (see FIGS. 1 and 3) of the active lever 25.

When the inside open lever 21 is rotationally driven from the initial position to the actuation position or when the outside open lever 22 is rotationally driven from the initial position to the actuation position, the open link 23 is pushed from the initial position illustrated in FIG. 2 or 3 toward the lift lever 12, and is moved to an actuation position. Further, when the active lever 25 moves from a locking position (position illustrated in FIG. 5(*c*)) to an unlocking position (position illustrated in FIG. 5(*a*)), the open link 23 is switchable to an unlocked state (state illustrated in FIG. 2), and when the active lever 25 moves from the unlocking position to the locking position, the open link 23 is switchable to a locked state (state illustrated in FIG. 3).

Note that, when the open link 23 is held in the unlocked state, actuations of the open levers 21 and 22 in a door opening direction along with the door opening operations of the door handles are transmitted to the lift lever 12 via the open link 23, respectively. On the other hand, when the open link 23 is held in the locked state, actuations of the open levers 21 and 22 in a door opening direction along with the door opening operations of the door handles are transmitted to the open link 23, but are not transmitted from the open link 23 to the lift lever 12.

The spring 24 is a return spring interposed between the outside open lever 22 and the open link 23, and urges the open link 23 into the unlocked state (state illustrated in FIG. 2) with respect to the outside open lever 22. Under a state in which the open link 23 is engaged with the active lever 25, the spring 24 constantly urges the active lever 25 toward the unlocking position. Further, the spring 24 includes a coil portion 24*a* mounted to the support portion 23*d* of the open link 23, and a pair of arm portions 24*b* and 24*c* extending radially outward from both end portions of a wire forming the coil portion 24*a*. The arm portion 24*b* engages with the outside open lever 22, and the arm portion 24*c* engages with the open link 23. Note that, an urging force of the spring 24 is set to be smaller than the urging force of the spring 27.

Thus, in the door-locked state (state in which the door is locked), when the door handles (not shown) and a lock/unlock operation member (lock knob (not shown) arranged on the inner side of the door, key cylinder (not shown) capable of being operated from the outer side of the door, remote control device for actuating an electric motor 31 (see FIG. 1) of a driving mechanism 30, or the like) are operated simultaneously and thus the vehicle door lock device is brought into a panic state, owing to the function of the spring 24, the open link 23 is urged to be brought into the unlocked state, and is retained elastically and relatively movable to the engagement arm portion 12*b* of the lift lever 12. In this manner, the open link 23 is permitted to return to the initial position illustrated in FIG. 2.

Figure 5:
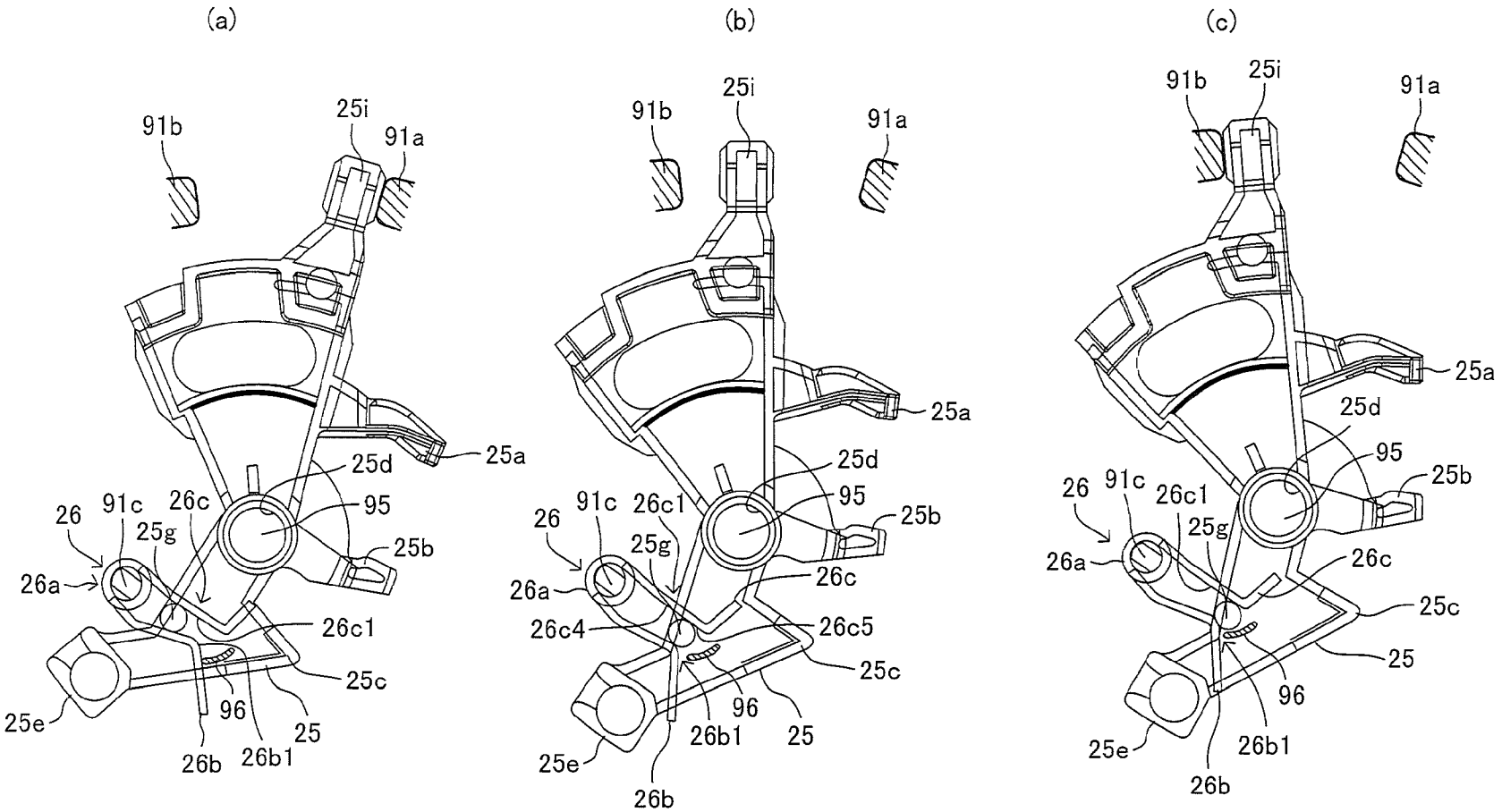
FIG. 5 are explanatory operational views illustrating a relationship between the active lever, the first stopper portion, the second stopper portion, and the torsion spring.

Through a locking operation of the lock/unlock operation member, the active lever 25 is rotationally shifted from the unlocking position illustrated in FIGS. 1 and 5(*a*) to the locking position illustrated in FIG. 5(*c*). When the active lever 25 is rotationally shifted to the locking position, the open link 23 is brought into the locked state illustrated in FIG. 3. Further, through an unlocking operation of the lock/unlock operation member, the active lever 25 is rotationally shifted from the locking position to the unlocking position. When the active lever 25 is rotationally shifted to the unlocking position, the open link 23 is brought into the unlocked state. At a support hole 25*d* formed in a boss portion of the active lever 25, the active lever 25 is supported by the housing 90 while being mounted to the housing 90 through intermediation of a support shaft 95 in a freely rotatable manner.

The active lever 25 includes the locking position holding guide 25*a*, the push arm portion 25*b*, the receiving portion

25*c*, and the support hole 25*d* mentioned above. The active lever 25 further includes an operation portion 25*e* coupled through an operation cable (not shown) to the lock knob (not shown) arranged on the inner side of the door, a driving portion 25*f* linked to the driving mechanism 30, an engagement pin portion 25*g* (see FIG. 1) engaged with a positioning torsion spring 26, and an engagement pin portion 25*h* linked through intermediation of a locking control lever 41, a key switch lever 42, an outside locking lever 43, and the like to the key cylinder (not shown) arranged on the outer side of the door.

Further, the active lever 25 includes a protruding portion 25*i* arranged between a first stopper portion (first stopper member) 91*a* and a second stopper portion (second stopper member) 91*b* that are arranged on the main body 91 of the housing 90. Then, owing to the positioning torsion spring 26 engaged with the engagement pin portion 25*g*, the active lever 25 is held elastically at the unlocking position (position at which the protruding portion 25*i* abuts against the first stopper portion 91*a* as illustrated in FIGS. 1 and 5(*a*)), or at the locking position (position at which the protruding portion 25*i* abuts against the second stopper portion 91*b* as illustrated in FIG. 5(*c*)).

A holding force (force of holding the active lever 25 at the locking position) of the torsion spring 26 is set to be larger than the urging force of the spring 27 (force for urging the outside open lever 22 toward the initial position). Thus, in the door-locked state, the outside open lever 22, the open link 23, the active lever 25, and the like are held in the state illustrated in FIG. 3.

Through the rotation of the active lever 25 from the unlocking position (position of FIG. 2) to the locking position (position of FIG. 3), the push arm portion 25*b* is engageable with the engagement leg portion 23*e* of the open link 23 so as to tilt the open link 23 in the unlocked state. Further, when the active lever 25 is located at the locking position, the push arm portion 25*b* is disengageable from the open link 23 so as to permit the open link 23 in the locked state to move into the unlocked state.

FIG. 5 are explanatory operational views illustrating a relationship between the active lever 25 (rotating lever), both the stopper portions 91*a* and 91*b* (stopper members), and the torsion spring 26. In FIG. 5, in order to clearly illustrate engagement between the engagement pin portion 25*g* of the active lever 25 and the torsion spring 26, the engagement pin portion 25*g* and the torsion spring 26 are each indicated by the solid lines.

As illustrated in FIG. 5, when the active lever 25 rotates in a clockwise direction in FIG. 5, the first stopper portion 91*a* abuts against the protruding portion 25*i* of the active lever 25, to thereby hold the active lever 25 at the unlocking position (first position). FIG. 5(*a*) is a view illustrating a relationship between the active lever 25, both the stopper portions 91*a* and 91*b*, and the torsion spring 26 when the active lever 25 is located at the unlocking position. Further, when the active lever 25 rotates in a counterclockwise direction in FIG. 5, the second stopper portion 91*b* abuts against the protruding portion 25*i* of the active lever 25, to thereby hold the active lever 25 at the locking position (second position). FIG. 5(*c*) is a view illustrating a relationship between the active lever 25, both the stopper portions 91*a* and 91*b*, and the torsion spring 26 when the active lever 25 is located at the locking position.

Figure 4:
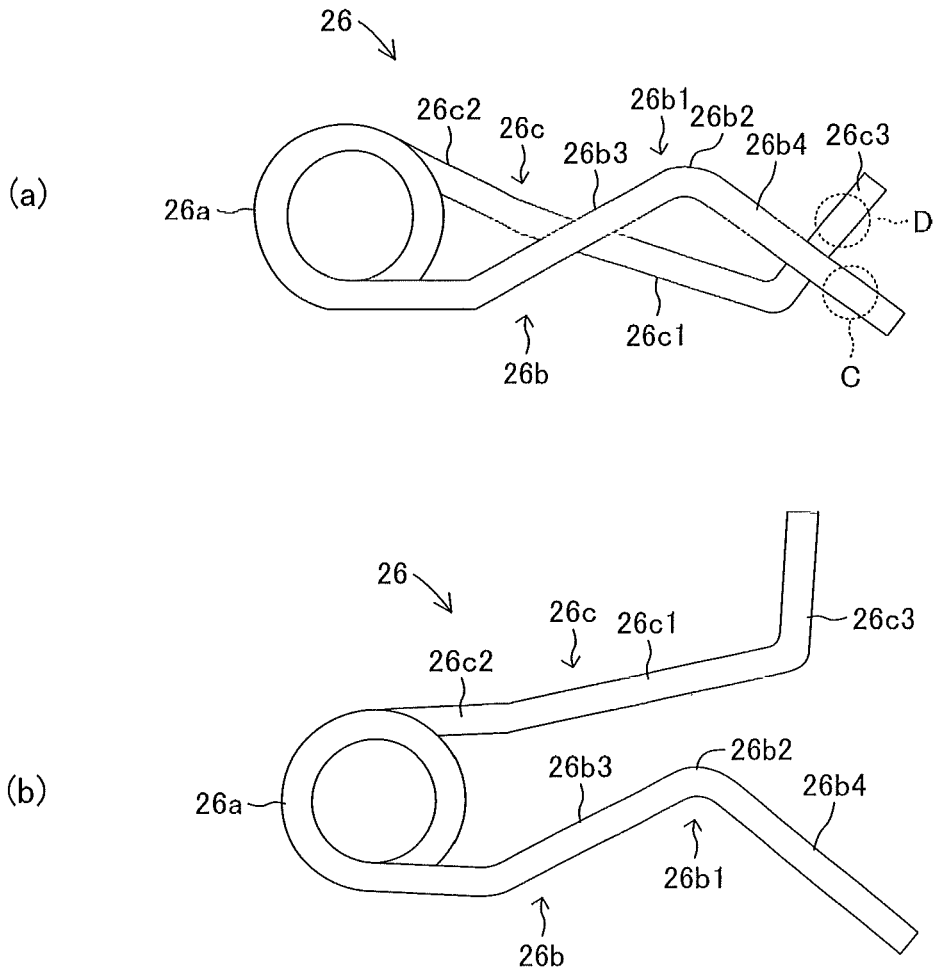
FIG. 4 are views illustrating a torsion spring, in which FIG. 4(*a*) is a side view illustrating the torsion spring in a free state, and FIG. 4(*b*) is a side view illustrating the torsion spring in a mounted state.

The torsion spring 26 is interposed between the active lever 25 and the main body 91 of the housing 90. The torsion spring 26 is configured to urge the protruding portion 25*i* of the active lever 25 in a first direction (clockwise direction) toward the first stopper portion 91*a* when the active lever 25 is located at the unlocking position as illustrated in FIG. 5(*a*), and to urge the protruding portion 25*i* of the active lever 25 in a second direction (counterclockwise direction) toward the second stopper portion 91*b* when the active lever 25 is located at the locking position as illustrated in FIG. 5(*c*). The torsion spring 26 is formed of a wire of spring steel, and includes a coiled part 26*a*, a first arm part 26*b*, and a second arm part 26*c*. In a free state, as illustrated in FIG. 4(*a*), the first arm part 26*b* and the second arm part 26*c* are closed so that the first arm part 26*b* and the second arm part 26*c* intersect with each other. The two arm parts 26*b* and 26*c* closed in the free state are opened and the engagement pin portion 25*g* is sandwiched between the two arm parts 26*b* and 26*c*. In this state, the torsion spring 26 is mounted to the main body 91 and the active lever 25. FIG. 4(*b*) illustrates the torsion spring in the mounted state.

The coiled part 26*a* is mounted so as to be rotatable about a boss portion 91*c* arranged upright from the main body 91 of the housing 90. Under a mounted state as illustrated in FIG. 1, the first arm part 26*b* and the second arm part 26*c* extend from both ends of a wire portion forming the coiled part 26*a* in a radial direction substantially orthogonal to an axial direction of the boss portion 91*c*, and face each other so as to sandwich the engagement pin portion 25*g* arranged on the active lever 25 from both sides thereof.

The first arm part 26*b* has a mountain portion 26*b*1 formed thereon. Under a state in which the torsion spring 26 is mounted to the housing 90 as illustrated in FIG. 4(*b*), the mountain portion 26*b*1 is formed into a shape that is convex toward the second arm part 26*c*. The mountain portion 26*b*1 includes a peak portion 26*b*2, a proximal end-side inclined portion (first inclined portion) 26*b*3, which is inclined from the peak portion 26*b*2 toward a proximal end of the first arm part 26*b*, and a distal end-side inclined portion (second inclined portion) 26*b*4, which is inclined from the peak portion 26*b*2 toward a distal end of the first arm part 26*b*. When the active lever 25 is located at the unlocking position, the engagement pin portion 25*g* of the active lever 25 abuts against the proximal end-side inclined portion 26*b*3. When the active lever 25 is located at the locking position, on the other hand, the engagement pin portion 25*g* of the active lever 25 abuts against the distal end-side inclined portion 26*b*4.

Further, the second arm part 26*c* has a proximal end portion 26*c*2, a straight portion 26*c*1 (reversely urging portion), and a distal end portion 26*c*3 formed thereon. The proximal end portion 26*c*2 is formed so as to extend from the coiled part 26*a*, and the straight portion 26*c*1 is continuously formed at a distal end side of the proximal end portion 26*c*2 so as to extend in a radially outward direction of the coiled part 26*a*. The distal end portion 26*c*3 extends from a distal end of the straight portion 26*c*1 so as to be bent substantially at a right angle. When the active lever 25 is located at a rotational position between the first position and the second position, the engagement pin portion 25*g* of the active lever 25 abuts against the straight portion 26*c*1.

Figure 8:
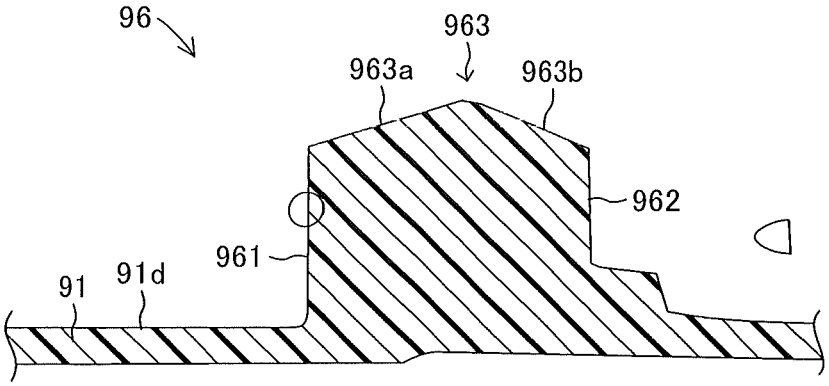
FIG. 8 is a sectional view taken along the line A-A of FIG. 1.

Further, as can be seen from FIG. 1, a rib (regulating member) 96 is formed on the main body 91 of the housing 90. The rib 96 is arranged upright from the main body 91, and is formed into a circular-arc shape in front view of FIG. 1. FIG. 8 is a sectional view taken along the line A-A of FIG. 1, for illustrating a sectional shape of the rib 96. As can be seen from FIG. 8, the rib 96 includes a first side wall surface 961 and a second side wall surface 962 formed so as to extend from an upper surface 91*d* of the main body 91 along an upright direction of the rib 96 (direction perpendicular to the upper surface 91*d*), and an upper wall surface 963 connecting upper ends of both the side wall surfaces 961 and 962. The upper wall surface 963 is formed into a shape that is convex upward. The upper wall surface 963 includes a first inclined upper surface portion 963*a*, which is inclined in an upward direction from the upper end of the first side wall surface 961 toward the second side wall surface 962 so that the position of the upper end of the first side wall surface 961 is lowest in height, and a second inclined upper surface portion 963*b*, which is inclined in the upward direction from the upper end of the second side wall surface 962 toward the first side wall surface 961 so that the position of the upper end of the second side wall surface 962 is lowest in height. As illustrated in FIG. 1, the rib 96 is formed on the main body 91 so that the rib 96 is positioned between the first arm part 26*b* and the second arm part 26*c* of the torsion spring 26, and that the first arm part 26*b* of the torsion spring 26 is abuttable against the first side wall surface 961.

In the vehicle door lock device according to this embodiment, which is constructed as described above, for example, when an operation force of the lock knob (not shown) is applied to the operation portion 25*e* of the active lever 25 through the operation cable, the active lever 25 rotates about the support shaft 95. As described above, the rotational range of the active lever 25 is regulated by the first stopper portion 91*a* and the second stopper portion 91*b*. Thus, the active lever 25 rotates between the unlocking position at which the active lever 25 abuts against the first stopper portion 91*a* and the locking position at which the active lever 25 abuts against the second stopper portion 91*b*.

When the active lever 25 rotates from the unlocking position to the locking position, or when the active lever 25 rotates from the locking position to the unlocking position, the engagement pin portion 25*g* of the active lever 25 moves along a circular-arc locus. At a midway point on the circular-arc locus, the engagement pin portion 25*g* climbs onto the peak portion 26*b*2 of the mountain portion 26*b*1 formed on the first arm part 26*b* of the torsion spring 26. The rotational position of the active lever 25 when the engagement pin portion 25*g* of the active lever 25 climbs onto the peak portion 26*b*2 of the mountain portion 26*b*1 is defined as a neutral position. The neutral position is a rotational position between the unlocking position and the locking position. FIG. 5(*b*) is a view illustrating a relationship between the active lever 25, both the stopper portions 91*a* and 91*b*, and the torsion spring 26 when the active lever 25 is located at the neutral position. When the active lever 25 is located at a rotational position in a range of from the unlocking position to the neutral position, the engagement pin portion 25*g* abuts against the proximal end-side inclined portion 26*b*3 of the first arm part 26*b* of the torsion spring 26 and the straight portion 26*c*1 of the second arm part 26*c* of the torsion spring 26. When the active lever 25 is located at a rotational position in a range of from the locking position to the neutral position, on the other hand, the engagement pin portion 25*g* abuts against the distal end-side inclined portion 26*b*4 of the first arm part 26*b* of the torsion spring 26 and the straight portion 26*c*1 of the second arm part 26*c* of the torsion spring 26.

Figure 6:
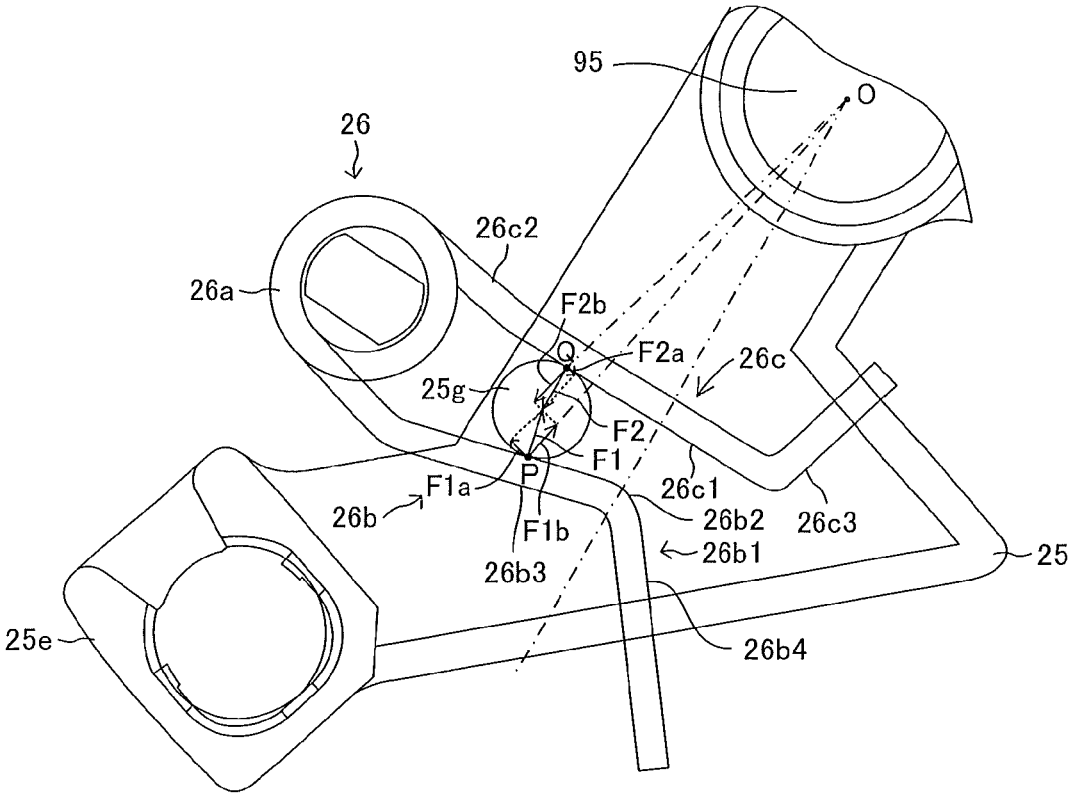
FIG. 6 is a view illustrating directions of forces acting from the torsion spring onto an engagement pin portion when the active lever is located at a rotational position in a range of from an unlocking position to a neutral position.

FIG. 6 is a view illustrating directions of forces acting from the torsion spring 26 onto the engagement pin portion 25*g* when the engagement pin portion 25*g* abuts against the proximal end-side inclined portion 26*b*3 of the first arm part 26*b* of the torsion spring 26 and the straight portion 26*c*1 of the second arm part 26*c* of the torsion spring 26, that is, when the active lever 25 is located at the rotational position in the range of from the unlocking position to the neutral position. In the state illustrated in FIG. 6, the first arm part 26*b* and the second arm part 26*c* of the torsion spring 26 squeeze the engagement pin portion 25*g* in a sandwiched manner. The squeezing force from the first arm part 26*b* is applied in a direction perpendicular to a tangential line at a contact point P between the proximal end-side inclined portion 26*b*3 and the engagement pin portion 25*g*. This squeezing force is represented as an elastic force F1 in FIG. 6. The elastic force F1 is resolved into a component along a rotational direction of the active lever 25 (direction perpendicular to a line segment connecting a rotational center O of the active lever 25 and the contact point P) (rotational component F1*a*) and a component along a radial direction thereof (radial component F1*b*). In the case illustrated in FIG. 6, the rotational component F1*a* is applied so as to rotate the active lever 25 along the clockwise direction in FIG. 6. In other words, the position of the contact point between the engagement pin portion 25*g* and the proximal end-side inclined portion 26*b*3 with respect to the rotational center O of the active lever 25 is determined so that the application direction of the rotational component F1*a* of the elastic force F1 at the position of the contact point between the engagement pin portion 25*g* and the proximal end-side inclined portion 26*b*3 corresponds to a direction in which the active lever 25 rotates clockwise in FIG. 6.

Further, the squeezing force from the second arm part 26*c* is applied in a direction perpendicular to a tangential line at a contact point Q between the straight portion 26*c*1 and the engagement pin portion 25*g*. This squeezing force is represented as an elastic force F2 in FIG. 6. The elastic force F2 is resolved into a component F2*a* along the rotational direction of the active lever 25 (direction perpendicular to a line segment connecting the rotational center O of the active lever 25 and the contact point Q) (rotational component) and a radial component F2*b*. In the case illustrated in FIG. 6, the rotational component F2*a* is applied so as to rotate the active lever 25 counterclockwise in FIG. 6. In other words, the position of the contact point between the engagement pin portion 25*g* and the straight portion 26*c*1 with respect to the rotational center of the active lever 25 is determined so that the application direction of the rotational component F2*a* of the elastic force F2 at the position of the contact point between the engagement pin portion 25*g* and the straight portion 26*c*1 corresponds to a direction in which the active lever 25 rotates counterclockwise in FIG. 6. Note that, a part at which the straight portion 26*c*1 of the second arm part 26*c* is brought into contact with the engagement pin portion 25*g* when the active lever 25 is located at the rotational position in the range of from the unlocking position to the neutral position, specifically, a part of the straight portion 26*c*1 that is closer to the proximal end with respect to the position at which the engagement pin portion 25*g* is brought into contact with the straight portion 26*c*1 when the active lever 25 is located at the neutral position (part 26*c*4 in FIG. 5(*b*)) corresponds to a first reversely urging portion.

Thus, the active lever 25 is rotationally urged with a resultant force of the rotational component F1*a* of the elastic force F1 and the rotational component F2*a* of the elastic force F2. In this case, the position of the contact point between the engagement pin portion 25*g* and the proximal end-side inclined portion 26*b*3, the position of the contact point between the engagement pin portion 25*g* and the straight portion 26*c*1 (first reversely urging portion), the magnitude of the elastic force F1 from the proximal end-side inclined portion 26*b*3, and the magnitude of the elastic force F2 from the straight portion 26*c*1 (first reversely urging portion) are defined so that the rotational component F2*a* of the elastic force F2 is smaller than the rotational component F1*a* of the elastic force F1. Thus, the resultant force of the above-mentioned components is applied to the active lever 25 so as to rotate the active lever 25 in the clockwise direction. The application direction of this resultant force is a direction in which the protruding portion 25*i* of the active lever 25 moves toward the first stopper portion 91*a*. Therefore, when the active lever 25 is located at the rotational position in the range of from the unlocking position to the neutral position, the protruding portion 25*i* is rotationally urged in a direction toward the first stopper portion 91*a* (clockwise direction). Further, when the active lever 25 is located at the unlocking position, the protruding portion 25*i* is elastically pressed against the first stopper portion 91*a*, thereby maintaining a state in which the active lever 25 is located at the unlocking position.

Figure 7:
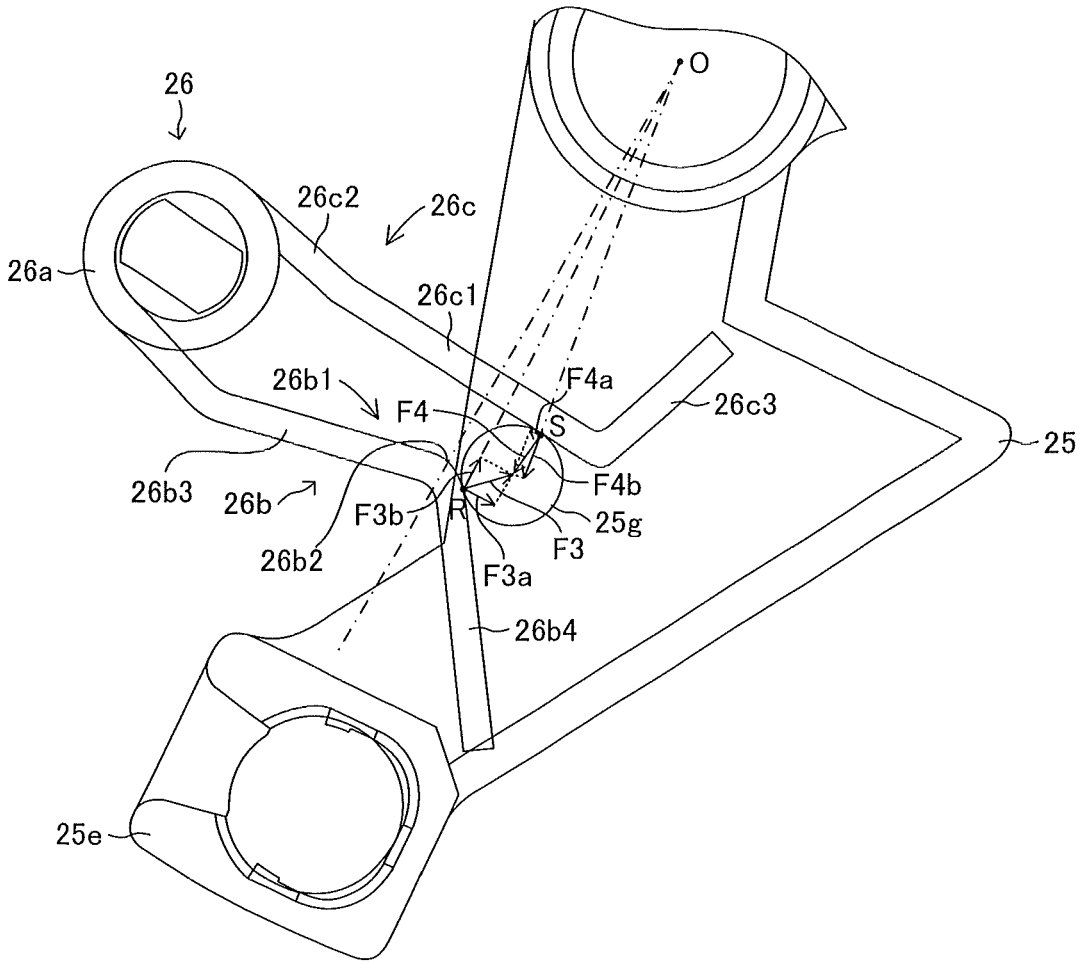
FIG. 7 is a view illustrating directions of forces acting from the torsion spring onto the engagement pin portion when the active lever is located at a rotational position in a range of from a locking position to the neutral position.

FIG. 7 is a view illustrating directions of forces acting from the torsion spring 26 onto the engagement pin portion 25*g* when the engagement pin portion 25*g* abuts against the distal end-side inclined portion 26*b*4 of the first arm part 26*b* of the torsion spring 26 and the straight portion 26*c*1 of the second arm part 26*c* of the torsion spring 26, that is, when the active lever 25 is located at the rotational position in the range of from the locking position to the neutral position. Also in the state illustrated in FIG. 7, the first arm part 26*b* and the second arm part 26*c* of the torsion spring 26 squeeze the engagement pin portion 25*g* in a sandwiched manner. The squeezing force from the first arm part 26*b* is applied in a direction perpendicular to a tangential line at a contact point R between the distal end-side inclined portion 26*b*4 and the engagement pin portion 25*g*. This squeezing force is represented as an elastic force F3 in FIG. 7. The elastic force F3 is resolved into a component F3*a* along the rotational direction of the active lever 25 (direction perpendicular to a line segment connecting the rotational center O of the active lever 25 and the contact point R) (rotational component) and a radial component F3*b*. In the case illustrated in FIG. 7, the rotational component F3*a* is applied so as to rotate the active lever 25 along the counterclockwise direction in FIG. 7. In other words, the position of the contact point between the engagement pin portion 25*g* and the distal end-side inclined portion 26*b*4 with respect to the rotational center O of the active lever 25 is determined so that the application direction of the rotational component F3*a* of the elastic force F3 at the position of the contact point between the engagement pin portion 25*g* and the distal end-side inclined portion 26*b*4 corresponds to a direction in which the active lever 25 rotates counterclockwise in FIG. 7.

Further, the squeezing force from the second arm part 26*c* is applied in a direction perpendicular to a tangential line at a contact point S between the straight portion 26*c*1 and the engagement pin portion 25*g*. This squeezing force is represented as an elastic force F4 in FIG. 7. The elastic force F4 is resolved into a component F4*a* along the rotational direction of the active lever 25 (direction perpendicular to a line segment connecting the rotational center O of the active lever 25 and the contact point S) (rotational component) and a radial component F4*b*. In the case illustrated in FIG. 7, the rotational component F4*a* is applied so as to rotate the active lever 25 clockwise in FIG. 7. In other words, the position of the contact point between the engagement pin portion 25*g* and the straight portion 26*c*1 with respect to the rotational center O of the active lever 25 is determined so that the application direction of the rotational component F4*a* of the elastic force F4 at the position of the contact point between the engagement pin portion 25*g* and the straight portion 26*c*1 corresponds to a direction in which the active lever 25 rotates clockwise in FIG. 7. Note that, a part at which the straight portion 26*c*1 of the second arm part 26*c* is brought into contact with the engagement pin portion 25*g* when the active lever 25 is located at the rotational position in the range of from the locking position to the neutral position, specifically, a part of the straight portion 26*c*1 that is closer to the distal end with respect to the position at which the engagement pin portion 25*g* is brought into contact with the straight portion 26*c*1 when the active lever 25 is located at the neutral position (part 26*c*5 in FIG. 5(*b*)) corresponds to a second reversely urging portion.

Thus, the active lever 25 is rotationally urged with a resultant force of the rotational component F3*a* of the elastic force F3 and the rotational component F4*a* of the elastic force F4. In this case, the position of the contact point between the engagement pin portion 25*g* and the distal end-side inclined portion 26*b*4, the position of the contact point between the engagement pin portion 25*g* and the straight portion 26*c*1 (second reversely urging portion), the magnitude of the elastic force F3 from the distal end-side inclined portion 26*b*4, and the magnitude of the elastic force F4 from the straight portion 26*c*1 (second reversely urging portion) are defined so that the rotational component F4*a* of the elastic force F4 is smaller than the rotational component F3*a* of the elastic force F3. Thus, the resultant force of the above-mentioned components is applied to the active lever 25 so as to rotate the active lever 25 in the counterclockwise direction. The application direction of this resultant force is a direction in which the protruding portion 25*i* of the active lever 25 moves toward the second stopper portion 91*b*. Therefore, when the active lever 25 is located at the rotational position in the range of from the locking position to the neutral position, the protruding portion 25*i* is rotationally urged in a direction toward the second stopper portion 91*b* (counterclockwise direction). Further, when the active lever 25 is located at the locking position, the protruding portion 25*i* is elastically pressed against the second stopper portion 91*b*, thereby maintaining a state in which the active lever 25 is located at the locking position.

When the active lever 25 rotates from the unlocking position in the counterclockwise direction so as to be rotationally shifted to the locking position, the engagement pin portion 25*g* climbs over the mountain portion 26*b*1 formed on the first arm part 26*b* of the torsion spring 26. Before the engagement pin portion 25*g* climbs over the mountain portion 26*b*1, that is, until the active lever 25 is rotationally shifted from the unlocking position to the neutral position, the torsion spring 26 urges the active lever 25 in the clockwise direction. The urging direction is opposite to the rotational direction of the active lever 25, and hence a resistance force to the rotation of the active lever 25 is received from the torsion spring 26. After the engagement pin portion 25*g* climbs over the mountain portion 26*b*1, that is, until the active lever 25 is rotationally shifted from the neutral position to the locking position, on the other hand, the torsion spring 26 urges the active lever 25 in the counterclockwise direction. The urging direction is the same as the rotational direction of the active lever 25, and hence the rotation of the active lever 25 is assisted by the torsion spring 26.

Also when the active lever 25 rotates from the locking position in the clockwise direction so as to be rotationally shifted to the unlocking position, the engagement pin portion 25*g* climbs over the mountain portion 26*b*1. Before the engagement pin portion 25*g* climbs over the mountain portion 26*b*1, that is, until the active lever 25 is rotationally shifted from the locking position to the neutral position, the torsion spring 26 urges the active lever 25 in the counter-clockwise direction. The urging direction is opposite to the rotational direction of the active lever 25, and hence a resistance force to the rotation of the active lever 25 is received from the torsion spring 26. After the engagement pin portion 25*g* climbs over the mountain portion 26*b*1, that is, until the active lever 25 is rotationally shifted from the neutral position to the unlocking position, on the other hand, the torsion spring 26 urges the active lever 25 in the clockwise direction. The urging direction is the same as the rotational direction of the active lever 25, and hence the rotation of the active lever 25 is assisted by the torsion spring 26.

As described above, irrespective of whether the active lever 25 is rotationally shifted from the unlocking position to the locking position or from the locking position to the unlocking position, the active lever 25 is urged in the rotational direction after moving through the neutral position. Therefore, tactile feedback can be given during the operation of switching the rotational position of the active lever 25.

Further, in this embodiment, irrespective of whether the active lever 25 is rotationally shifted from the unlocking position to the locking position or from the locking position to the unlocking position, the active lever 25 receives, after moving through the neutral position, a rotational assist force (urging force acting in a direction of assisting the rotation) from the first arm part 26*b* of the torsion spring 26 and a rotational resistance force (urging force acting in a direction of inhibiting the rotation) smaller in magnitude than the rotational assist force from the second arm part 26*c* of the torsion spring 26. Due to the rotational resistance force, the magnitude of the urging force in the rotational direction is reduced relatively, thereby being capable of preventing such a situation that the active lever 25 is rotationally urged with a great urging force and therefore the protruding portion 25*i* forcefully strikes against the first stopper portion 91*a* or the second stopper portion 91*b* to cause significant abutment noise.

Further, the second arm part 26*c* includes the straight portion 26*c*1 formed so as to extend linearly. The straight portion 26*c*1 includes the part (first reversely urging portion) 26*c*4 for applying the rotational resistance force to the active lever 25 when the active lever 25 moves through the neutral position toward the unlocking position, and the part (second reversely urging portion) 26*c*5 for applying the rotational resistance force to the active lever 25 when the active lever 25 moves through the neutral position toward the locking position. In this manner, the single straight part includes the first reversely urging portion and the second reversely urging portion, and hence a torsion spring having the above-mentioned functions can be manufactured relatively easily, with the result that the manufacturing cost can be reduced.

Moreover, in this embodiment, the rib 96 is formed on the main body 91 of the housing 90. As described above, the rib 96 is formed on the main body 91 so that the rib 96 is positioned between the first arm part 26*b* and the second arm part 26*c* of the torsion spring 26. Further, the rib 96 is arranged at such a position that the first arm part 26*b* of the torsion spring 26 abuts against the first side wall surface 961 immediately before the active lever 25 reaches the unlocking position during the rotation of the active lever 25 from the locking position toward the unlocking position.

Thus, the first arm part 26*b* of the torsion spring 26 abuts against the rib 96 immediately before the active lever 25 reaches the unlocking position through the rotation from the locking position toward the unlocking position, to thereby regulate further deflection (movement) of the first arm part 26*b*. Through the regulation of further deflection (movement) of the first arm part 26*b*, the engagement pin portion 25*g* is not further squeezed by the first arm part 26*b*. As a result, the elastic force F1 applied from the first arm part 26*b* to the engagement pin portion 25*g* is limited in magnitude to the elastic force applied to the engagement pin portion 25*g* immediately before the first arm part 26*b* abuts against the rib 96. When the first arm part 26*b* does not abut against the rib 96, the engagement pin portion 25*g* is continuously squeezed by the first arm part 26*b* until the active lever 25 reaches the unlocking position, and hence the rotational component F1*a* of the elastic force F1 becomes the maximum when the active lever 25 reaches the unlocking position. In other words, through the regulation of the movement (deflection) of the first arm part 28*b* by the rib 96 before the active lever 25 reaches the unlocking position, the rotational component F1*a* of the elastic force F1 when the active lever 25 reaches the unlocking position is limited to the rotational component F1*a* of the elastic force F1 when the movement (deflection) of the first arm part 28*b* is regulated by the rib 96. Through the limitation of the rotational component F1*a*, the rotational assist force is reduced. Therefore, the abutment noise can further be reduced when the active lever 25 abuts against the first stopper portion 91*a*. As a result, there is no need to take any other measures to reduce the abutment noise, thereby being capable of preventing the increase in number of components and cost of materials for the measures to reduce the abutment noise.

Further, through the use of the rib 96 having the shape described in this embodiment, the mountability of the torsion spring 26 to the main body 91 is enhanced. As described above, the upper wall surface 963 of the rib 96 includes the first inclined upper surface portion 963*a* and the second inclined upper surface portion 963*b*. When mounting the torsion spring 26 to the main body 91, the torsion spring 26 is arranged above the rib 96 so that the first arm part 26*b* of the torsion spring 26 (for example, portion C of FIG. 4(*a*)) in the free state as illustrated in FIG. 4(*a*) is placed on the first inclined upper surface portion 963*a* of the rib 96 and the second arm part 26*c* of the torsion spring 26 (for example, portion D of FIG. 4(*a*)) is placed on the second inclined upper surface portion 963*b* of the rib 96. Then, the torsion spring 26 is pressed downward (toward the main body 91). Along with this, the first arm part 26*b* slides along the first inclined upper surface portion 963*a* and the second arm part 26*c* slides along the second inclined upper surface portion 963*b*. The sliding direction of the first arm part 26*b* is opposite to the sliding direction of the second arm part 26*c*, and hence, when both the arm parts 26*b* and 26*c* slide along the respective inclined upper surface portions, the interval between the closed (crossed) first and second arm parts 26*b* and 26*c* is increased. Then, the first arm part 26*b* falls from the upper end of the first side wall surface 961 and the second arm part 26*c* falls from the upper end of the second side wall surface 962. Accordingly, the rib 96 is sandwiched between the first arm part 26*b* and the second arm part 26*c*. Then, the torsion spring 26 is mounted to the main body 91 under a state in which the engagement pin portion 25*g* is sandwiched between the first arm part 26*b* and the second arm part 26*c* that are opened by sandwiching the rib 96 therebetween. In this manner, the torsion spring 26 is mounted easily under the opened state, and hence the mountability is enhanced.

Figure 9:
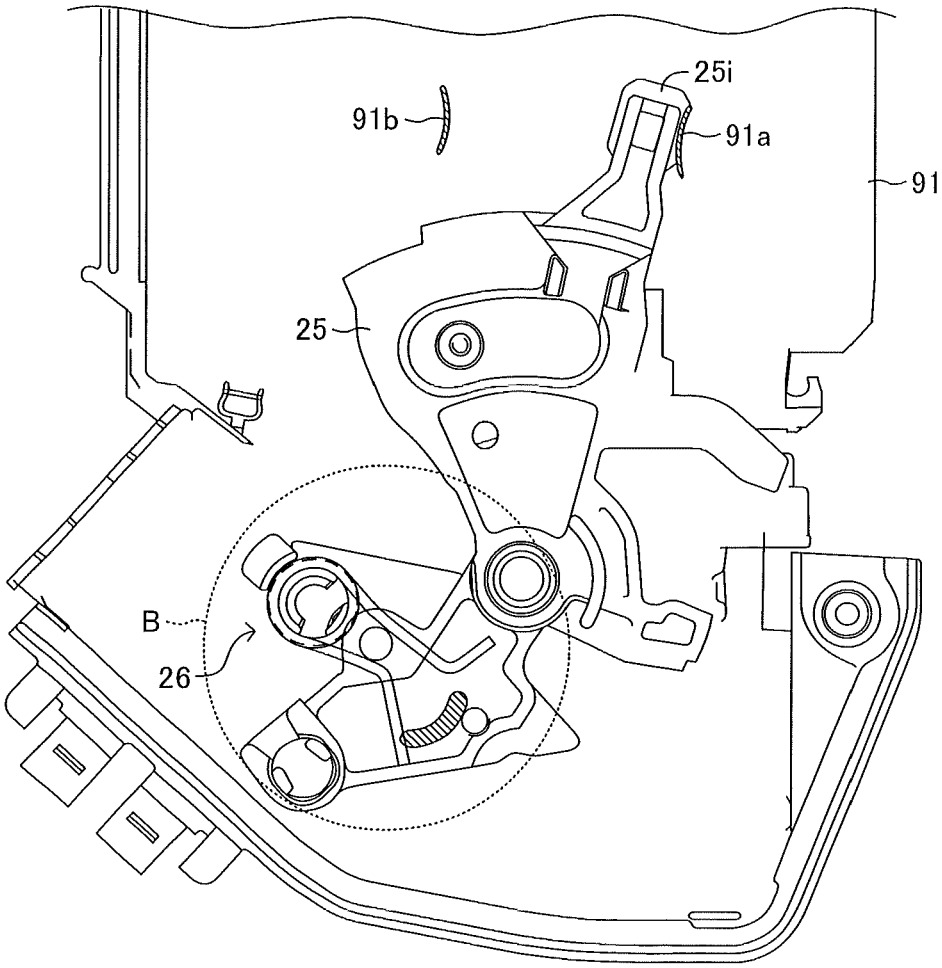
FIG. 9 is a view illustrating another vehicle door lock device to which the position holding device for a rotating lever according to the embodiment of the present invention is applied.
Figure 10:
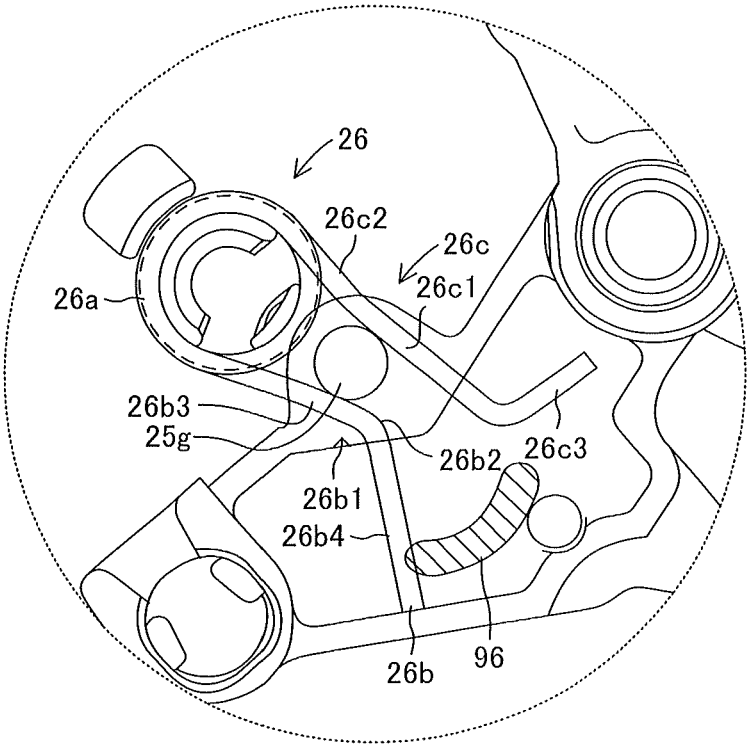
FIG. 10 is a detailed view illustrating the region B of FIG. 9.

The embodiment of the present invention is described above, but the present invention is not limited to the embodiment described above. The embodiment described above is directed to the example in which the present invention is applied to the door lock device to be mounted to the door installed on the front side of the vehicle (front door). Alternatively, as illustrated in FIGS. 9 and 10, the present invention may also be applied to a door lock device to be mounted to a door installed on a rear side of the vehicle (rear door). Note that, FIG. 9 is a view illustrating a relationship of arrangement between the active lever 25 (engagement pin portion 25*g*), the first stopper portion 91*a*, the second stopper portion 91*b*, and the torsion spring 26, which are mounted to the main body 91 of the housing 90 of the door lock device to be mounted to the rear door. FIG. 10 is a detailed view illustrating the region B of FIG. 9. Further, in the embodiment described above, the active lever 25 is taken as an example of the rotating lever, but the present invention may also be applied to other such levers that tactile feedback is desired during rotational operations thereof. In this manner, the present invention may be modified without departing from the gist of the present invention.

The invention claimed is:

1. A position holding device for a rotating lever, comprising:

a base member having a support portion;

a rotating lever rotatably supported by the base member;

a first stopper member configured to abut against the rotating lever when the rotating lever rotates in a first direction, to thereby hold the rotating lever at a first position;

a second stopper member configured to abut against the rotating lever when the rotating lever rotates in a second direction opposite to the first direction, to thereby hold the rotating lever at a second position; and a torsion spring interposed between the rotating lever and the base member, the torsion spring being configured to urge the rotating lever in the first direction when the rotating lever is located at the first position, and to urge the rotating lever in the second direction when the rotating lever is located at the second position, the torsion spring comprising:

a coiled part mounted so as to be rotatable about the support portion; and a first arm part and a second arm part each extending from the coiled part so as to sandwich an engagement portion formed on the rotating lever from both sides thereof, the first arm part comprising a mountain portion formed into a shape that is convex toward the second arm part, the mountain portion comprising:

a peak portion onto which the engagement portion climbs when the rotating lever is located at a neutral position between the first position and the second position;

a first inclined portion configured to urge the rotating lever in the first direction when the rotating lever is located at a rotational position between the neutral position and the first position; and a second inclined portion configured to urge the rotating lever in the second direction when the rotating lever is located at a rotational position between the neutral position and the second position, the second arm part comprising a reversely urging portion formed thereon, the reversely urging portion being configured to engage with the engagement portion when the rotating lever is located at the rotational position between the neutral position and the first position, to thereby urge the rotating lever in the second direction with a force smaller than a force for urging the rotating lever in the first direction by the first inclined portion, the base member comprising a regulating member configured to abut against the first arm part when the rotating lever rotates toward the first position through the neutral position.

2. A position holding device for a rotating lever according to claim 1, wherein the reversely urging portion comprises:

a first reversely urging portion configured to engage with the engagement portion when the rotating lever is located at the rotational position between the neutral position and the first position, to thereby urge the rotating lever in the second direction with the force smaller than the force for urging the rotating lever in the first direction by the first inclined portion; and a second reversely urging portion configured to engage with the engagement portion when the rotating lever is located at the rotational position between the neutral position and the second position, to thereby urge the rotating lever in the first direction with a force smaller than a force for urging the rotating lever in the second direction by the second inclined portion.

3. A position holding device for a rotating lever according to claim 1, wherein the torsion spring is mounted to the base member, and is formed so as to assume a crossed state in which the first arm part and the second arm part are crossed under a free state, and the regulating member is configured to bring the torsion spring out of the crossed state by guiding, when the torsion spring in the free state is to be mounted to the base member, the first arm part and the second arm part so that an interval between the first arm part and the second arm part is increased.

4. A position holding device for a rotating lever according to claim 1, wherein the regulating member comprises a rib formed on the base member so as to be arranged upright from the base member, the rib comprises:

a first side wall surface and a second side wall surface each extending along an upright direction of the rib; and an upper wall surface connecting an upper end of the first side wall surface and an upper end of the second side wall surface, the first side wall surface is abuttable against the first arm part, and the upper wall surface comprises:

a first inclined upper surface portion, which is inclined in an upward direction from the upper end of the first side wall surface so that a position of the upper end of the first side wall surface is lowest in height; and a second inclined upper surface portion, which is inclined in the upward direction from the upper end of the second side wall surface so that a position of the upper end of the second side wall surface is lowest in height.

5. A position holding device for a rotating lever according to claim 3, wherein the torsion spring is mounted to the base member by arranging the first arm part of the torsion spring in the free state on the first inclined upper surface portion, arranging the second arm part of the torsion spring on the second inclined upper surface portion, and under a state in which the first arm part is arranged on the first inclined upper surface portion and the second arm part is arranged on the second inclined upper surface portion, pushing the torsion spring in the free state so that the interval between the first arm part and the second arm part is increased, to thereby mount the torsion spring to the base member under a state in which the engagement portion is sandwiched between the first arm part and the second arm part.

6. A position holding device for a rotating lever according to claim 2, wherein the second arm part comprises a straight portion formed so as to extend linearly, and the first reversely urging portion and the second reversely urging portion are formed on the straight portion.

* * * * *